US009924750B2

(12) United States Patent
MacNeil

(10) Patent No.: US 9,924,750 B2
(45) Date of Patent: Mar. 27, 2018

(54) ATHLETIC PROTECTIVE SHIELD

(71) Applicant: Gregory Joseph MacNeil, Toronto (CA)

(72) Inventor: Gregory Joseph MacNeil, Toronto (CA)

(73) Assignee: SKATE-CUT-PROOF INC., Toronto (CA)

( * ) Notice: Subject to any disclaimer, the term of this patent is extended or adjusted under 35 U.S.C. 154(b) by 0 days.

(21) Appl. No.: 14/656,883

(22) Filed: Mar. 13, 2015

(65) Prior Publication Data

US 2016/0021954 A1 Jan. 28, 2016

Related U.S. Application Data

(63) Continuation-in-part of application No. 14/338,875, filed on Jul. 23, 2014, now abandoned.

(51) Int. Cl.

| | |
|---|---|
| ***A41D 13/05*** | (2006.01) |
| ***A63B 71/12*** | (2006.01) |
| ***A41D 31/00*** | (2006.01) |

(52) U.S. Cl.

CPC ..... *A41D 31/0055* (2013.01); *A41D 13/0543* (2013.01); *A63B 71/1225* (2013.01);

(Continued)

(58) Field of Classification Search

CPC .... A41D 13/0543; A41D 17/00; A41D 17/02; A41D 31/0055; A41D 1/08; A41D 13/05; A41D 13/06; A41D 13/065; A41D 13/08; A41D 13/088; A41D 13/0015; A41D 13/015; A41D 13/043; A41D 13/055; A41D 13/0556; A41D 13/0568; A41D 13/0581; A41D 19/01505; A41D 19/01511; A41D 31/0061; A41B 11/00; F41H 1/02;

(Continued)

(56) References Cited

U.S. PATENT DOCUMENTS 2,532,024 A 11/1950 Hoffman
2,617,207 A * 11/1952 Jennett ..... A43B 5/1691 2/22

(Continued)

FOREIGN PATENT DOCUMENTS

WO WO 2014/005208 A1 * 1/2014 ..... A41D 13/00

OTHER PUBLICATIONS

Parent U.S. Appl. No. 14/338,875, filed Jul. 23, 2014; Title: Athletic Protective Shield; Applicant: Gregory Joseph MacNeil.

(Continued)

*Primary Examiner* — Amy Vanatta
(74) *Attorney, Agent, or Firm* — Perry + Currier Inc.

(57) ABSTRACT

A protective shield for a lower leg of an ice skater is provided. The protective shield comprises a protective segment and a support segment to which the protective segment is secured. The protective segment comprises a web of interlocking metal loops. The protective segment is shaped and sized to fit over at least a rear portion of the lower leg including at least a portion of an Achilles tendon and at least a portion of a calf. The support segment is shaped and sized to fit around the lower leg, and is resilient to hold the protective shield in place around the lower leg during skating and to tension the protective segment against the rear portion of the lower leg.

20 Claims, 12 Drawing Sheets

(52) U.S. Cl.
CPC ..... *A41D 13/05* (2013.01); *A63B 2071/1241* (2013.01); *A63B 2071/1258* (2013.01); *A63B 2071/1266* (2013.01); *A63B 2244/183* (2013.01)

(58) Field of Classification Search
CPC ..... F41H 1/00; F41H 5/08; A63B 71/1225; A63B 2071/1266; A63B 2071/1241; A63B 2071/1258; A63B 2071/1275; A63B 2244/183; A61F 5/0102; A61F 5/0118; A61F 5/013; A61F 13/06
USPC ..... 2/2.5, 239, 22, 242, 16.22, 23
See application file for complete search history.

(56) References Cited

U.S. PATENT DOCUMENTS 3,670,339 A * 6/1972 Cooper ..... A41D 1/08 2/22
4,057,853 A * 11/1977 McLane ..... A41D 17/00 2/22
4,306,315 A 12/1981 Castiglia
4,493,865 A * 1/1985 Kuhlmann ..... A41D 19/01511 2/158
4,507,353 A * 3/1985 Kuhlmann ..... A41D 31/0055 2/2.5
RE32,506 E * 9/1987 Hightower, Jr. ..... A41D 17/00 2/2.5
4,802,242 A * 2/1989 Lars-Jos ..... A41D 31/0055 2/16
4,856,110 A * 8/1989 Giesick ..... A41B 11/00 2/22
5,052,052 A * 10/1991 Gilford ..... A41D 13/015 2/16
5,054,126 A * 10/1991 Rivkin ..... A41D 19/01511 2/16
5,088,123 A * 2/1992 MacDonald ..... A41D 19/01511 2/161.6
5,210,877 A * 5/1993 Newman ..... A41D 1/067 2/115
D354,615 S 1/1995 Parker
5,472,769 A * 12/1995 Goerz, Jr. ..... B32B 5/26 2/2.5
5,511,241 A * 4/1996 Ziegler ..... A41D 19/01511 2/16
D386,297 S 11/1997 Minnick et al.
5,729,831 A * 3/1998 Kuhlmann ..... A41D 19/01511 2/159
5,742,945 A * 4/1998 Lindaman ..... A41B 11/00 2/22
5,894,602 A * 4/1999 Smith ..... A41F 1/06 2/159
6,094,748 A * 8/2000 Kindler ..... A41D 19/01505 2/16
6,457,182 B1 * 10/2002 Szczesuil ..... A41D 19/01511 2/16
6,470,832 B1 * 10/2002 Peacock ..... A01K 13/007 119/850
D528,269 S 9/2006 Smith, III
7,237,272 B2 * 7/2007 Botcher ..... A41D 19/01511 2/161.6
D551,351 S 9/2007 Silva
7,389,547 B1 * 6/2008 Wiens ..... A41D 1/08 2/227
7,772,142 B2 8/2010 Kawano et al.
D643,208 S 8/2011 Schmidt et al.
D658,359 S 5/2012 Spring
D681,313 S 5/2013 Goins
D683,908 S 6/2013 Pasloski
8,671,462 B2 * 3/2014 Garcia ..... D04B 1/14 2/102
8,955,726 B1 2/2015 Thielman et al.
D742,102 S 11/2015 Minogue
2002/0073473 A1 * 6/2002 Bachner, Jr. ..... F41H 1/02 2/2.5
2004/0031079 A1 2/2004 Horvath et al.
2006/0218707 A1 * 10/2006 Julkunen ..... A41D 31/0055 2/455
2007/0101475 A1 * 5/2007 Skottheim ..... A41D 13/015 2/69
2007/0234467 A1 * 10/2007 Leach ..... A41B 11/12 2/227
2009/0210992 A1 * 8/2009 Duhatschek ..... A41D 19/01511 2/162
2009/0271912 A1 * 11/2009 Jaunault ..... A41D 19/01511 2/160
2010/0319098 A1 * 12/2010 Watt ..... A41D 17/00 2/22
2011/0094000 A1 4/2011 Shumate
2011/0131706 A1 * 6/2011 Andersson ..... A41B 11/02 2/239
2012/0180196 A1 * 7/2012 Tock ..... A41B 11/02 2/239
2012/0233735 A1 * 9/2012 Rhodenizer ..... A63B 71/1225 2/22
2012/0278981 A1 * 11/2012 Ialenti ..... A41B 11/02 2/468
2013/0160176 A1 * 6/2013 Magri ..... A41D 13/0543 2/22
2014/0213946 A1 * 7/2014 Singleton ..... A61F 5/0102 602/12
2014/0289924 A1 * 10/2014 Cleveland ..... A61F 13/08 2/2.5
2014/0359913 A1 * 12/2014 Magri ..... A63B 71/1225 2/22
2015/0052654 A1 * 2/2015 Thom ..... A41B 11/00 2/2.5
2015/0208745 A1 * 7/2015 Duhatschek ..... A41D 19/01511 2/463
2015/0231483 A1 * 8/2015 Rudow ..... A63B 71/1225 2/24

OTHER PUBLICATIONS

Requirement for Restriction/Election dated Dec. 4, 2015 for Design U.S. Appl. No. 29/502,963.
Non-Final Rejection dated Apr. 22, 2016 for U.S. Appl. No. 14/338,875.

* cited by examiner

ATHLETIC PROTECTIVE SHIELD

FIELD OF THE INVENTION

The present invention relates to athletic protective shields, and in particular athletic shields that protect the user against cuts.

BACKGROUND OF THE INVENTION

Athletes often wear protective gear in sports where there is a potential for injurious contact. In ice hockey, the skate blade poses a cutting danger. This danger is significant given the sharpness of the skate blade and the high speeds at which hockey players skate on the rink and frequently collide with one another. Laceration by the skate blade, particularly of the lower leg including the calf and the Achilles tendon, has been known to sideline recreational and professional hockey players. With player size, speed, and skill increasing every year, the frequency of this type of injury is on the rise. For example, in the past, Erik Karlsson of the Ottawa Senators, Andre Markov of the Montreal Canadians, Kevin Bieksa of the Vancouver Canucks, and Dave Bolland of the Toronto Maple Leafs have all suffered severe skate cuts to the Achilles and/or calf area. Such injuries may have long-term consequences for a player's career and general health. The above mentioned players missed over 200 NHL games as a direct result of their skate lacerations.

Ice hockey skates provide some protection for the lowermost portion of the Achilles tendon. However, the calf and the remaining portions of the Achilles tendon remain susceptible to laceration by the skate blade. Existing protective gear for the Achilles tendon and the calf often uses aramids or high molecular weight polyethylene to provide resistance to cuts by the skate blade. These materials are typically spun into a fiber and incorporated in a fabric that forms part of the hockey player's uniform.

While these materials may be somewhat harder to cut than cotton and other synthetic fabrics used for hockey uniforms, it is highly uncertain whether they would be able to protect the calf and the Achilles tendon from deep cuts by a sharpened skate blade in a collision between two hockey players moving at full-speed. For example, Claude Giroux, the Captain of the Philadelphia Flyers received a skate cut to his calf while wearing a Kevlar sock advertised to be "cut resistant". Given the serious consequences of deep cuts by the skate blade which can severely damage the calf and the Achilles tendon, aramid or polyethylene-based protective fabrics are not able to provide the level of skate cut-protection required for optimum player safety.

SUMMARY OF THE INVENTION

According to an aspect of the present specification there is provided a protective shield for a lower leg of an ice skater, the protective shield comprising a protective segment and a support segment to which the protective segment is secured. The protective segment comprises a web of interlocking metal loops. The protective segment is shaped and sized to fit over at least a rear portion of the lower leg including at least a portion of an Achilles tendon and at least a portion of a calf. The support segment is shaped and sized to fit around the lower leg, and is resilient to hold the protective shield in place around the lower leg during skating and to tension the protective segment against the rear portion of the lower leg.

According to another aspect of the present specification there is provided a protective shield for a lower leg of an ice skater, the protective shield comprising a protective segment and a support segment to which the protective segment is secured. The protective segment comprises a metal mesh. The protective segment is shaped and sized to fit over at least a rear portion of the lower leg including at least a portion of an Achilles tendon and at least a portion of a calf. The support segment is shaped and sized to fit around the lower leg, and is resilient to hold the protective shield in place around the lower leg during skating and to tension the protective segment against the rear portion of the lower leg.

According to another aspect of the present specification there is provided an athletic protective shield, comprising a protective segment and a support segment to which the protective segment is secured. The protective segment comprises a web of interlocking metal loops, and is shaped and sized to fit over a body part of a user. The support segment is shaped and sized to fit around the body part, and is resilient to hold the athletic protective shield in place around the body part during athletic movement and to tension the protective segment against the body part.

According to another aspect of the present specification there is provided a protective shield for a lower leg of an ice skater, the protective shield comprising a protective segment and a support segment to which the protective segment is secured. The protective segment comprises a web of interlocking metal loops made of steel or titanium. The protective segment is shaped and sized to fit over at least a rear portion of the lower leg including at least a portion of a calf and at least a portion of an Achilles tendon. The support segment comprises elastane and is permanently secured to the protective segment to form a unitary hockey sock shaped and sized to fit around the lower leg. The support segment is resilient to hold the protective shield in place around the lower leg during skating and to tension the protective segment against the rear portion of the lower leg.

According to another aspect of the present specification there is provided a protective shield for a lower leg of an ice skater, the protective shield comprising a protective segment and a support segment to which the protective segment is secured. The protective segment comprises a web of interlocking metal loops. The protective segment is shaped and sized to fit over at least a rear portion of the lower leg including at least a portion of an Achilles tendon and at least a portion of a calf. The support segment comprises at least one impact absorbing section. The support segment is shaped and sized to fit around the lower leg, and at least a portion of the support segment is resilient to hold the protective shield in place around the lower leg during skating and to tension the protective segment against the rear portion of the lower leg.

According to another aspect of the present specification there is provided an athletic protective shield, comprising a protective segment and a support segment to which the protective segment is secured. The protective segment comprises a web of interlocking metal loops. The protective segment is shaped and sized to fit over at least a portion of a body part of a user. The support segment comprises at least one impact absorbing section. The support segment is shaped and sized to fit around the body part, and the support segment is configured to hold the athletic protective shield in place around the body part during athletic movement and to tension the protective segment against the body part.

BRIEF DESCRIPTION OF THE DRAWINGS

For a better understanding of the various embodiments described herein and to show more clearly how they may be carried into effect, reference will now be made, by way of example only, to the accompanying drawings.

FIG. 1B depicts a magnified region of FIG. 1A.

DETAILED DESCRIPTION OF THE INVENTION

The protective shield of the present invention uses a web of interlocking loops as a protective element for the calf and the Achilles tendon. Such webs can be highly resistant to being cut by the skate blade during normal hockey conditions, and can be sufficiently flexible to conform to the contours of a body part such as the lower leg. In addition, webs of interlocking loops can be relatively light and breathable. The web of interlocking loops can be secured to a resilient support segment, which can fit over a body part of the user and hold the protective shield in place during athletic movement.

Figure 1A:
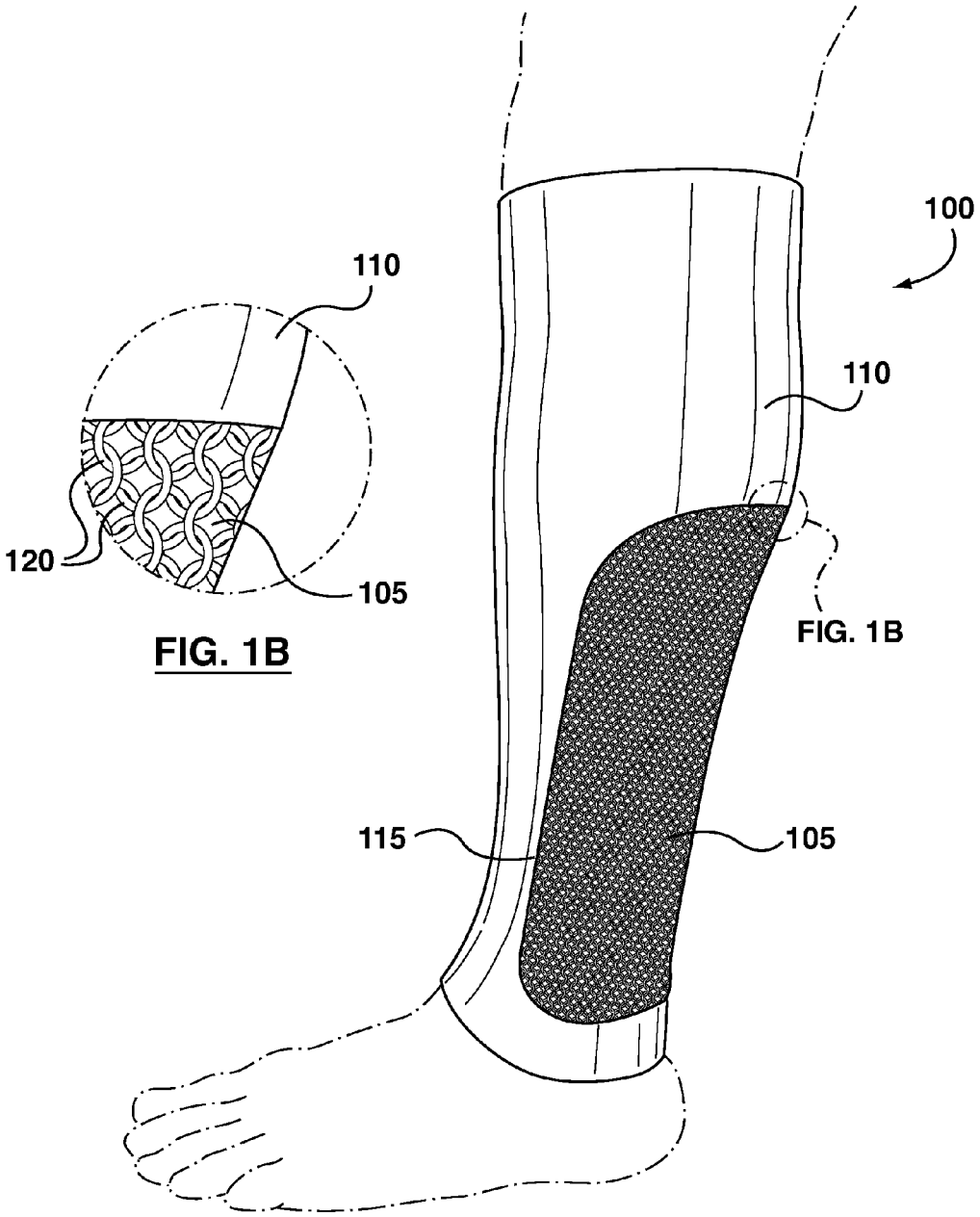
FIG. 1A depicts a side elevation view of an embodiment of the protective shield worn on the lower leg of a user.

FIG. 1A shows an embodiment of the protective shield 100, worn on the lower leg of a user and viewed from the side. Protective shield 100 includes a protective segment 105 secured to a support segment 110. Protective shield 100 can have any suitable shape that is shaped and sized to fit over a body part of a user. In the embodiment shown in FIG. 1A, protective shield 100 is shaped as a hockey sock, i.e. a knee-high sock without the foot section. The hockey sock is in effect a sleeve intended to cover the region of the lower leg extending from about the ankle to about the area below the knee. In other embodiments, the protective shield can be shaped and sized to fit around different body parts such as the neck, the fore-arms, the upper-arms, the upper legs, and the abdomen.

As shown in FIG. 1A, protective shield 100 can be worn on the lower leg, with protective segment 105 covering and protecting at least a rear portion of the lower leg including at least a portion of the Achilles tendon and/or at least a portion of the calf.

Protective segment 105 can protect the user from cuts and other physical dangers. For example, in the case of ice hockey the protective segment can protect the player from being cut by the blade of the hockey skate. The protective segment can also help to distribute and attenuate blunt force impact. Protective segment 105 can be made up of a web of interlocking loops. FIG. 1B shows a magnified region of FIG. 1A, and shows interlocking loops 120 forming a web which makes up protective segment 105. Such webs can be flexible, able to conform to the contours of a user's body part, and relatively light weight. When the loops are made of a material that is resistant to being cut, the web of interlocking loops can provide a cut-resistant protective segment. When the loop material is strong enough to withstand slashing from a hockey skate blade during normal game conditions, the protective segment can be considered to be hockey skate cut proof.

The loops can include metal including but not limited to titanium, carbon steel, stainless steel, and other steel alloys. The loops can be made wholly of metal. The loops can, alternatively or additionally, be formed using polymeric materials including but not limited to high molecular weight polyethylene, polypropylene, polyester or aramids. Not all loops need be identical. The web can be a mix of interlocking loops of metallic and non-metallic materials. When the loops are metallic, one or more of them can be welded to form unbroken loop(s). These loops can be stronger than open loops that are formed by simply bending a metal wire into a loop shape.

Protective segment 105 can alternatively or additionally be made of a metal mesh, which can be made of interlaced metal wires or stamped out from a metal sheet. Protective segment 105 can alternatively or additionally be made of a fabric made of threads of aramids, Kevlar™, Vectran™, polyesters, polyethelene, polypropylene, and high-density microfiber.

Support segment 110 can be made of fabric. The fabric can be resilient, including but not limited to fabrics including elastane, high grade Lycra™, and Spandex™ fibers. Support segment 110 can additionally or alternatively include other resilient materials such as rubber or silicone. Support segment 110 can include straps or laces. Support segment 110 can be shaped and sized to fit around a body part of the user, which can be, but is not limited to, the lower leg as shown in FIG. 1A. In embodiments where support segment 110 is made of a resilient material, support segment 110 can be sized and shaped so that it becomes stretched when protective shield 100 is worn around a body part such as the lower leg. The resilience of support segment 110, then, can hold protective shield 100 in place around a body part such as the lower leg during athletic movement such as skating. The resilience of the stretched support segment 110 can also tension protective segment 105 against the body to be protected, which can be the calf and/or the Achilles tendon as shown in FIG. 1A.

Protective segment 105 can be permanently secured to support segment 110 to form a unitary piece, such as protective shield 100. Any suitable means can be used to secure protective segment 105 to support segment 110; such means can include but are not limited to fusing, bonding, gluing, sewing, taping, or any combination of such. Protective segment 105 can also be releasably securable to support segment 110, using suitable means including but not limited to one or more hook-and-loop fasteners, one or more zipper, buttons, one or more laces, or any combination of such.

Although support segment 110 can tension the web of interlocking loops 120 of protective segment 105 when protective shield 100 is worn, the interlocking design can allow interlocking loops to retain the ability to move relative to one another when protective segment 105 is struck by an object such as the blade of another's skate. This relative movement can dissipate some of the striking blade's energy and can make it more difficult for the blade to cut through the web of interlocking loops. In this sense, interlocking loops 120 can be considered to be able to float relative to one another. This ability to float can apply to all embodiments of the present invention which comprise a web of interlocking loops.

When support segment 110 is made of a resilient material, while protective shield 100 is worn protective segment 105 can move relative to support segment 110 when protective segment 105 is struck by an object such as another's skate blade. Alternatively and/or in addition, when worn, protective shield 100 as a whole may be able to move relative to the body of the wearer when protective shield 100 is struck by an object such as another's skate blade. These relative movements can dissipate some of the striking blade's energy and can make it more difficult for the blade to cut through protective segment 105 and/or protective shield 100. In this sense, protective segment 105 and/or protective shield 100 can be considered to be floating or suspended relative to the body of the wearer. This property of being suspended or floating can apply to all embodiments of the present invention.

Several factors can contribute to making the protective shield comfortable to ware. These factors include, but are not limited to: relatively light weight of the protective shield; breathability of the protective segment and support segment materials; flexibility of the protective segment and/or the support segment allowing the protective shield to conform to the contours of the wearer's body and to fit snugly; relatively comfortable feel of the protective shield against the skin; and the ability of the protective shield to remain in place during vigorous athletic movement including, but not limited to, skating. These factors, to varying extents, can apply to all embodiments of the present invention.

Figure 2:
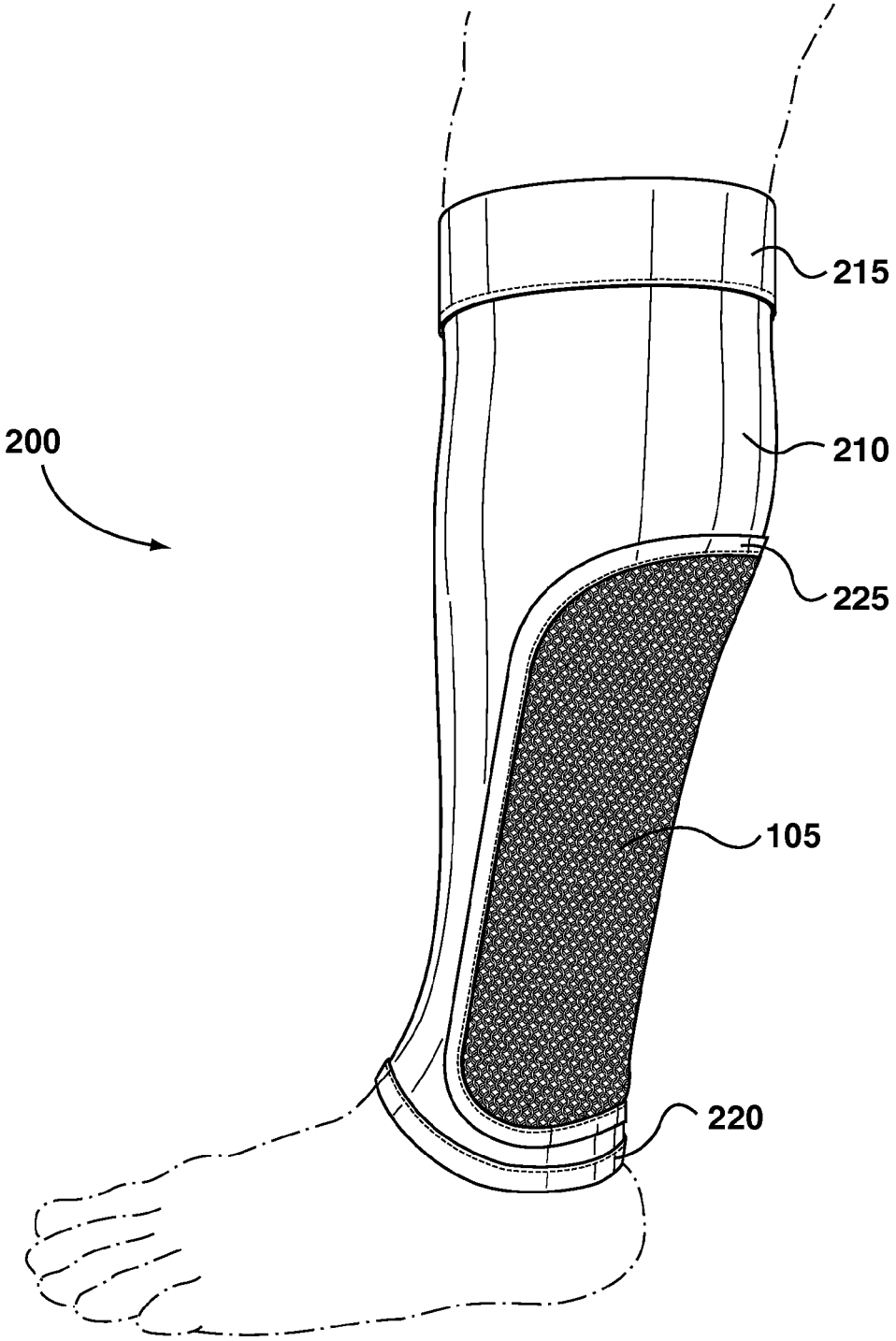
FIG. 2 depicts a side elevation view of another embodiment of the protective shield worn on the lower leg of a user, in which the support segment can have a cuff.

FIG. 2 shows another embodiment of the protective shield 200, worn on the lower leg of a user and viewed from the side. Protective shield 200 can be made up of protective segment 105 secured to support segment 210. Support segment 210 can have a cuff 215 near its end that is to be worn near the knee. Cuff 215 can be a region of thicker fabric, folded fabric, stitched fabric, and/or otherwise strengthened or different material. Cuff 215 can have additional resilience to hold protective shield 200 in place around the lower leg, particularly during vigorous athletic movement such as ice staking. In addition, the thicker or reinforced material of cuff 215 can prevent the edge of support segment 210 from rolling onto itself under tension.

Hem 220 can have a structure and function similar to cuff 215. Protective segment 105 can be secured to support segment 210 along seam 225. The securing can be achieved using a suitable means including but not limited to fusing, bonding, gluing, sewing, taping or any combination of such.

Figure 3:
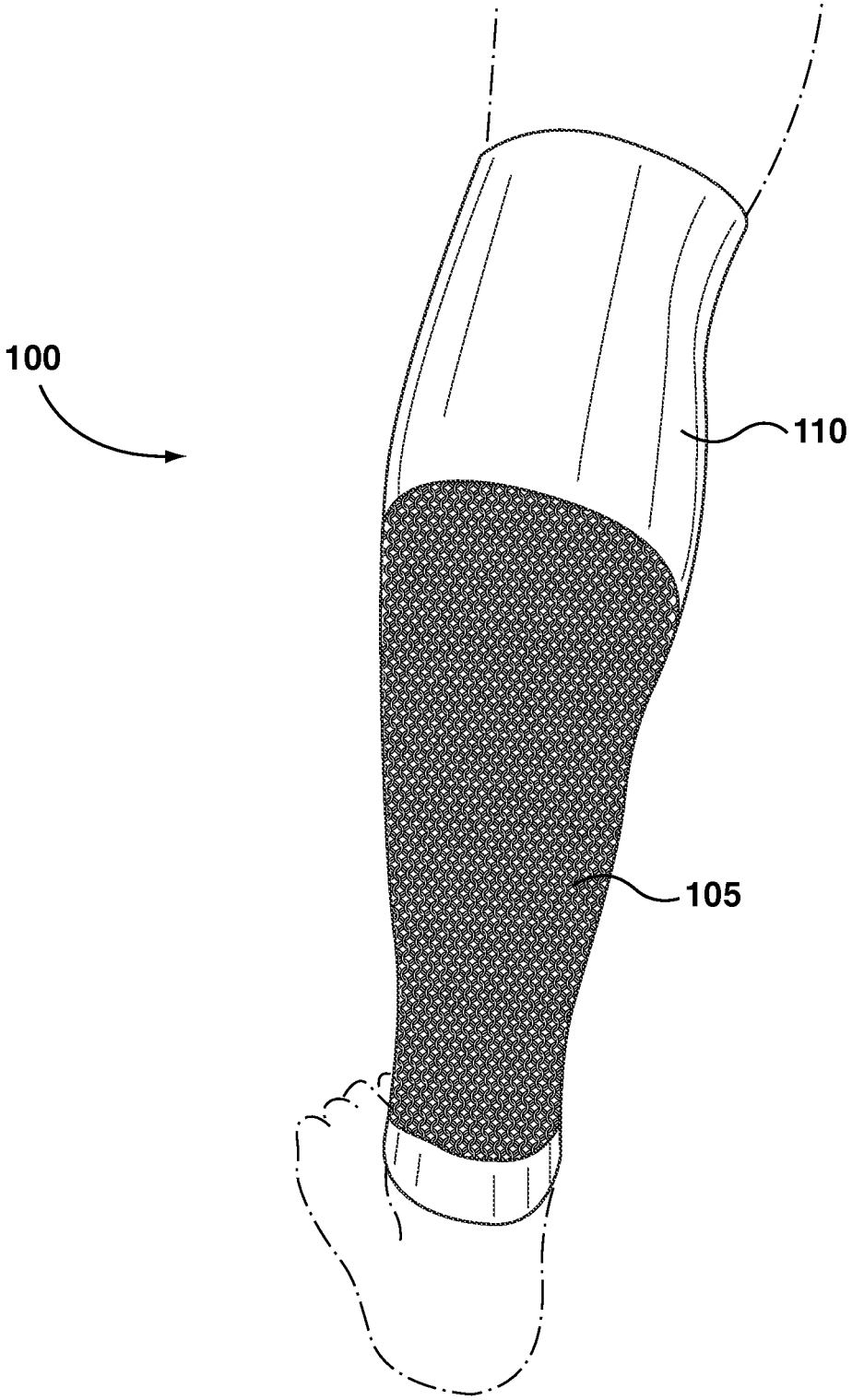
FIG. 3 depicts a rear elevation view of the protective shield of FIG. 1A worn on the lower leg of a user.

FIG. 3 shows an embodiment of the protective shield 100, worn on the lower leg of a user and viewed from behind. Protective segment 105 can cover at least a part of the calf and a part of the Achilles tendon. Protective segment 105 is secured to support segment 110, which can fit around the lower leg, hold protective shield 100 in place during ice skating movement, and tension protective segment 105 against the rear portion of the lower leg.

Figure 4:
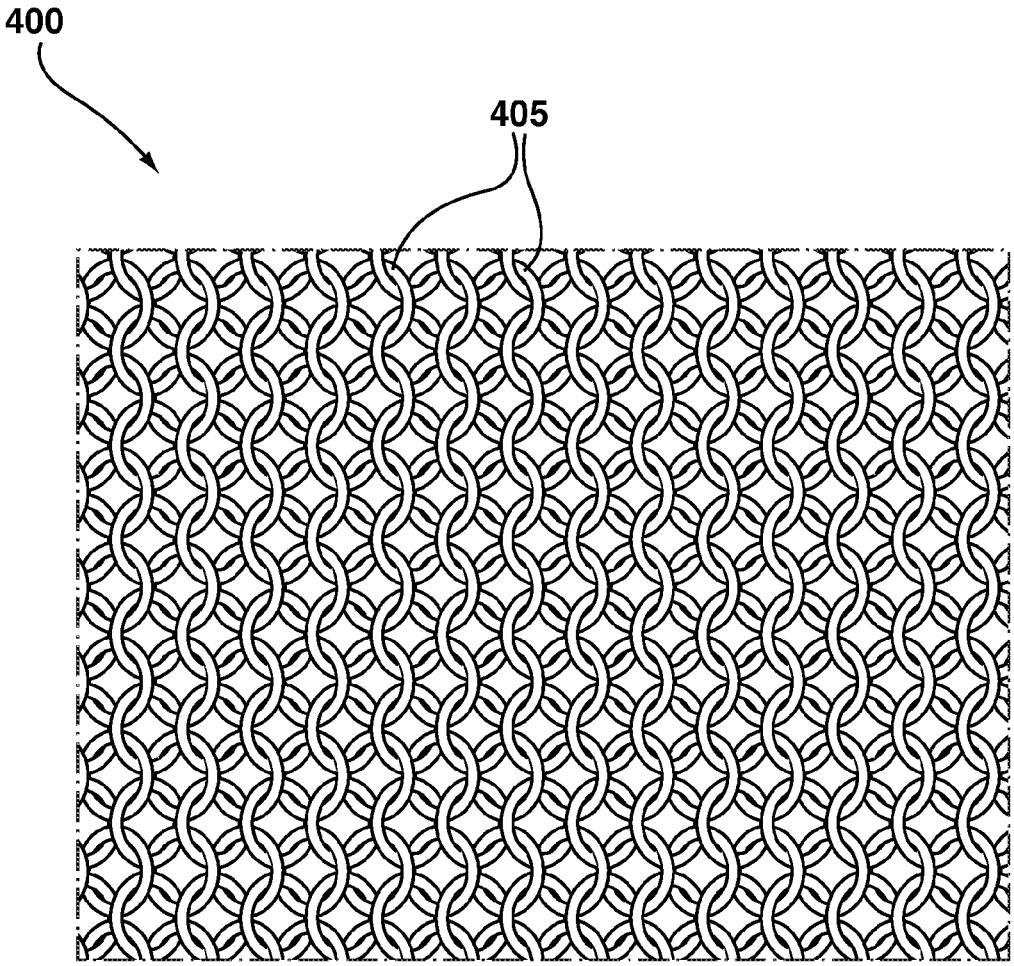
FIG. 4 depicts an example pattern of a web of interlocking loops according to an embodiment.

FIG. 4 shows an example pattern of a web 400 of interlocking loops 405 that can be used for any of the protective segments discussed herein. In this example pattern, each loop 405 is interlocked with 4 adjacent loops. In general, any suitable pattern for a web of interlocking loops can be used. In other embodiments, each loop is interlocked with at least two other loops. In other patterns, loops can be interlocked with one another and with other elements including but not limited to plates and wires. In some embodiments, loops 405 can be of 4.0 or 7.0 ring size. Loops 405 can be made of grade 4 titanium, or other suitable grades of titanium. In addition, loops 405 can be made of 304 stainless steel or 316 stainless steel. Web 400 of interlocking loops 405 can comprise pieces of 21 gauge wire formed into interlocking circular loops of 7/32 inches diameter, with each circle being welded to form an unbroken loop. Other suitable loop materials, loop diameters and thicknesses, and web interlocking patterns can also be used.

Figure 5:
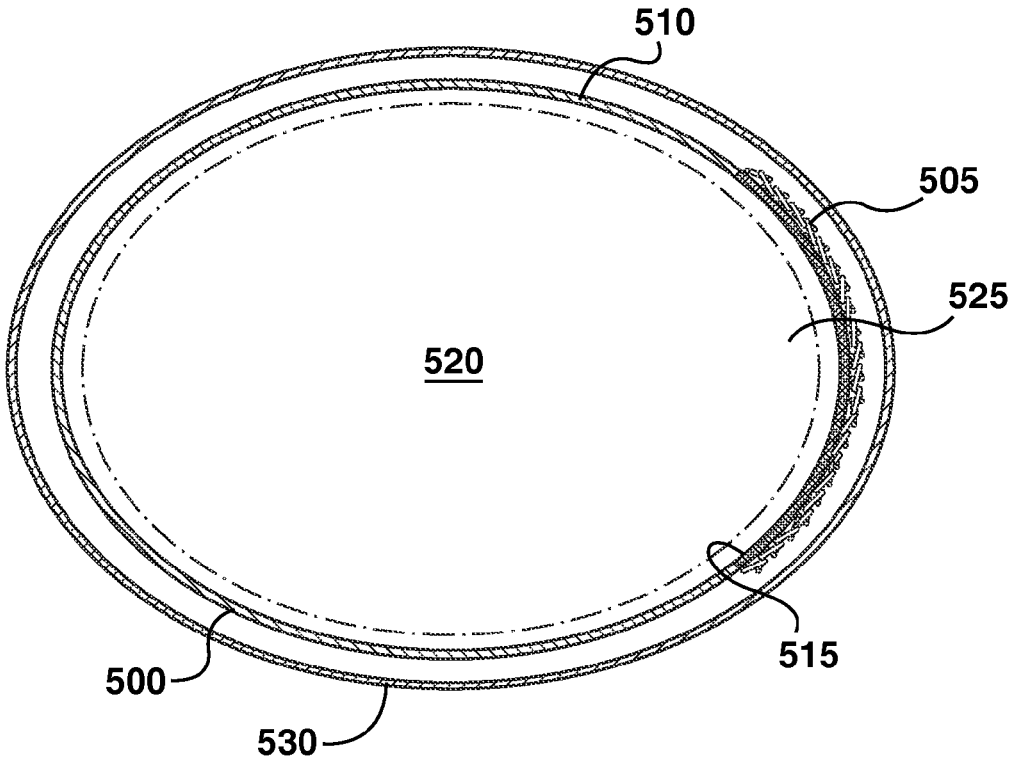
FIG. 5 depicts a cross-section of another embodiment of the protective shield worn on the lower leg of a user, in which a fabric layer can cover one side of the web of interlocking loops.

FIG. 5 shows a cross-section of an embodiment of the protective shield 500, worn on the lower leg 520 of a user, as viewed from above. Protective shield 500 can have a protective segment 505 secured to a support segment 510. Protective segment 505 can be made of a web of interlocking loops. Protective segment 505 can be the similar to protective segment 105 described above. Protective segment 505 can have a fabric layer 515 covering one side of the web of interlocking loops. When protective shield 500 is worn over lower leg 520, fabric layer 515 can be interposed between the skin of the user and the interlocking loops. Fabric layer 515 can increase comfort, and can be made of any other suitable material including but not limited to foam, mesh, and fabric containing elastane or Lycra™ fibers. Fabric layer 515 can be an extension of the support segment 510, or can be a different material secured to support segment 510 using any suitable method including fusing, bonding, gluing, sewing, taping, or any combination of such. In some embodiments, not shown, a fabric layer can cover the outside surface of protective segment 505 that faces away from the leg of the user. The fabric layers described above can be incorporated into any of the embodiments described herein.

When worn as part of an ice hockey uniform, protective shield 500 can be worn around lower leg 520, with protective segment 505 covering at least a portion of the calf 525 and/or a portion of the Achilles tendon. A regular hockey sock 530 can be worn over protective shield 500. In FIG. 5 protective shield 500 and hockey sock 530 are shown as spaced from leg 520 to clearly show each layer; when worn, protective shield 500 and hockey sock 530 can be tight against the leg 520 of the user. In addition, protective shield 500 and other parts of the athletic uniform can be worn in different orders against the user's body part. For example, other parts of the uniform can be worn between the user's leg and protective shield 500, and/or protective shield 500 can be the outermost layer worn over other parts of the uniform.

Figure 6:
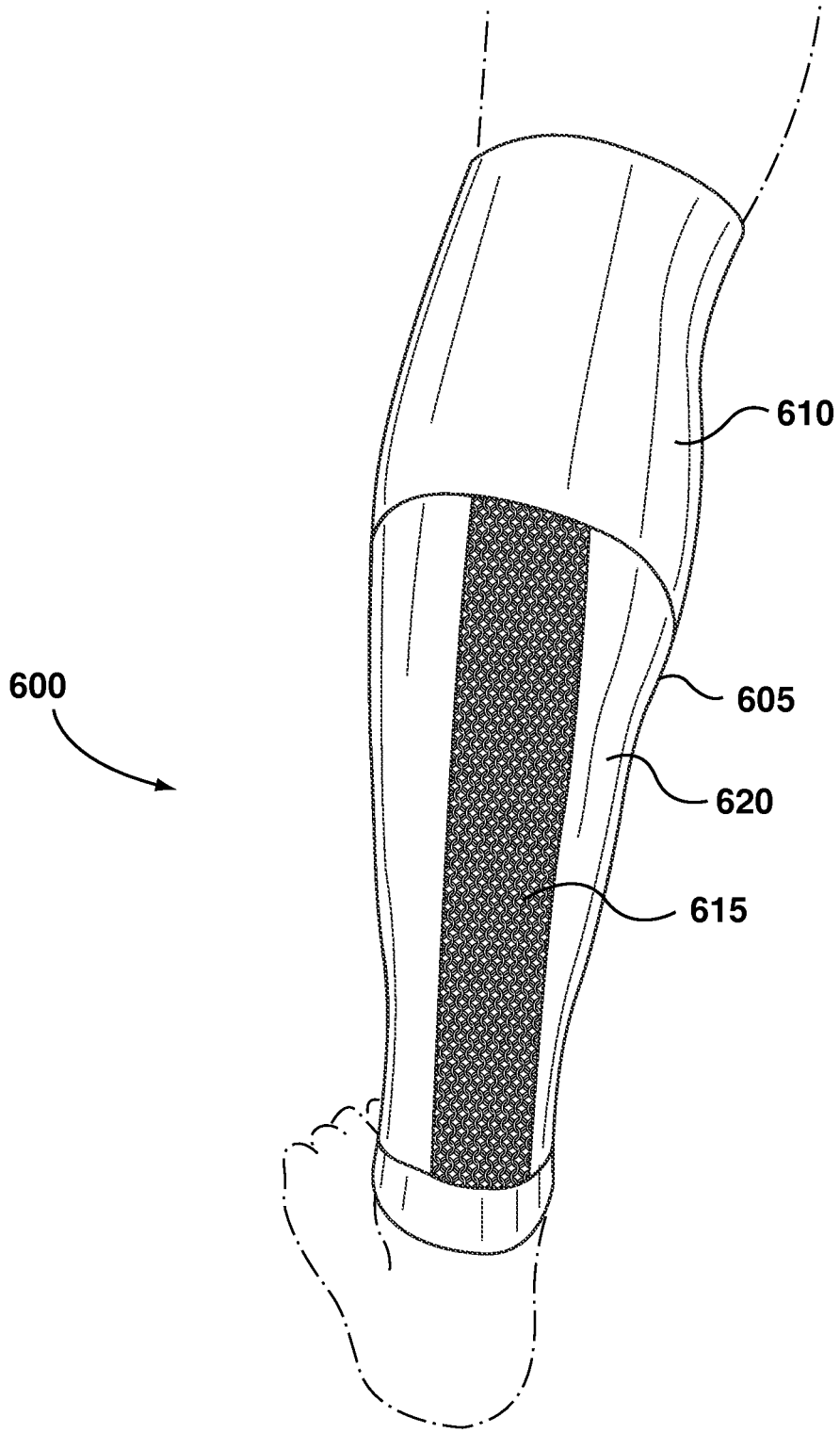
FIG. 6 depicts a rear elevation view of another embodiment of the protective shield worn on the lower leg of a user, in which the protective segment can comprise a web of interlocking loops and a cut resistant fabric.

FIG. 6 shows an embodiment of the protective shield 600, worn on the lower leg of a user and viewed from behind. Protective shield 600 comprises protective segment 605 secured to support segment 610. Protective segment 605 can be made up of different materials including but not limited to a web 615 of interlocking loops and a cut resistant fabric 620. Web 615 of interlocking loops can have properties similar to the interlocking loops of protective segment 105 discussed above. Cut resistant fabric 620 can have fibers made of a material including but not limited to aramids, Kevlar™, Vectran™, polyesters, polyethylene, polypropylene, and high-density microfiber. Cut resistant fabric 620 can be secured to the web 615 of interlocking loops and to support segment 610 using any suitable method including but not limited to fusing, bonding, gluing, sewing, and taping. When the protective shield is used for different parts of the body, the relative size and shape of the web of interlocking loops and the cut resistant fabric can be changed to optimize protection for each body part. In some embodiments, support segment 610 can be made of cut resistant fabric.

Figure 7:
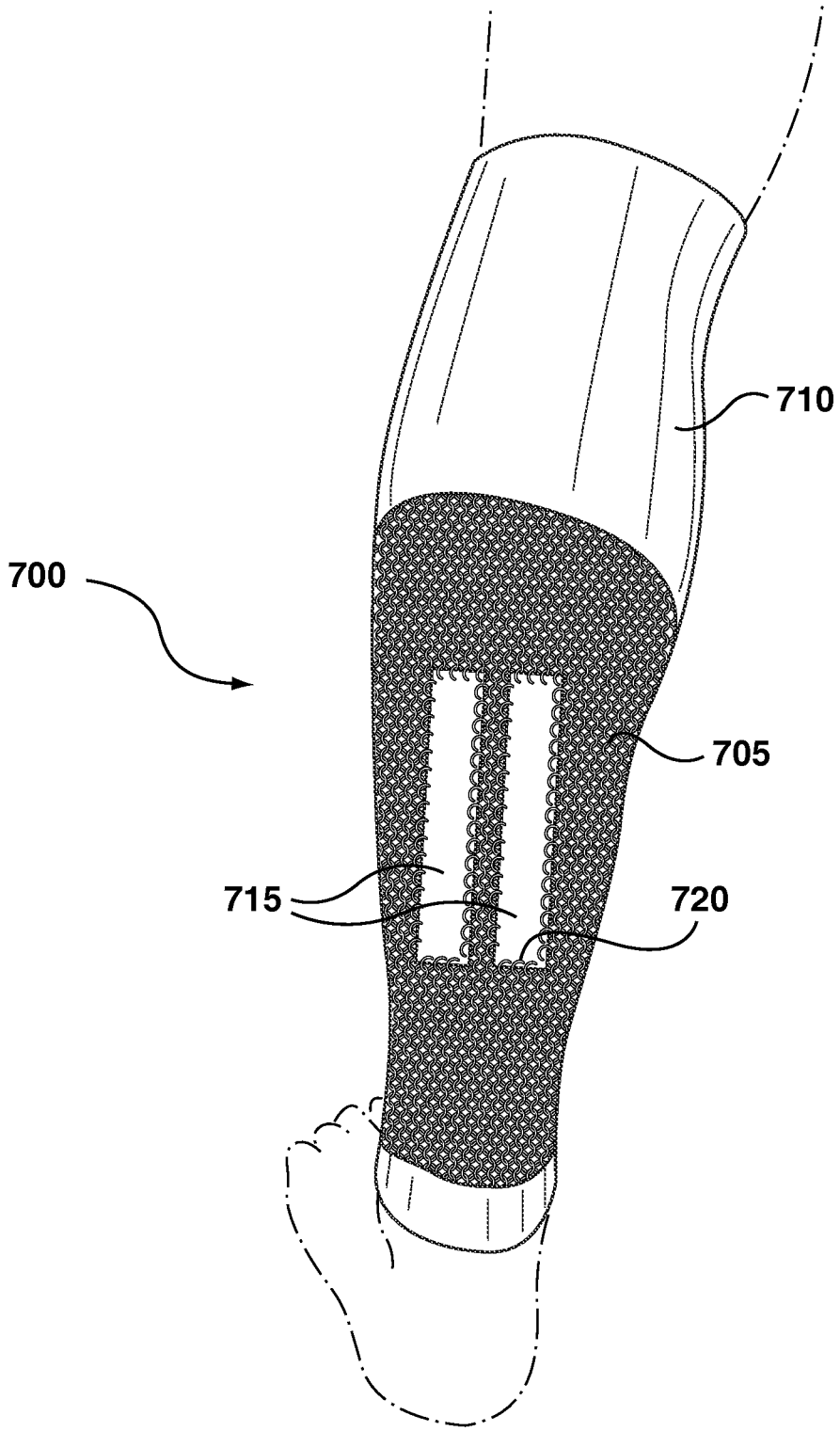
FIG. 7 depicts a rear elevation view of another embodiment of the protective shield worn on the lower leg of a user, in which the protective segment can have one or more plates interlocked with the web of interlocking loops.

FIG. 7 shows an embodiment of the protective shield 700, worn on the lower leg of a user and viewed from behind. Protective shield 700 comprises protective segment 705 secured to support segment 710. Protective segment 705 can have one or more plates 715 interlocked with the web of interlocking loops 720. The web of interlocking loops 720 can have properties similar to the interlocking loops of protective segment 105 discussed above. The number, size, and shape of the plates can be chosen to tailor protection for the part of the body being protected by protective shield 700. Plates 715 can be secured to loops 720 by any method including but not limited to interlocking and hinging, so long as the method provides for sufficient movement to allow protective segment 705 to move and flex during athletic movement and to follow the contours of the user's body. In some embodiments, other structures including but not limited to rods, meshes, and frames can be included in web of interlocking loops 720. Plates 715 can be made of metal, or other suitable materials including but not limited to high molecular weight polyethylene, high-tensile polymers, and carbon fiber composite. Plates 715 can be made of the same material or different materials.

Figure 8:
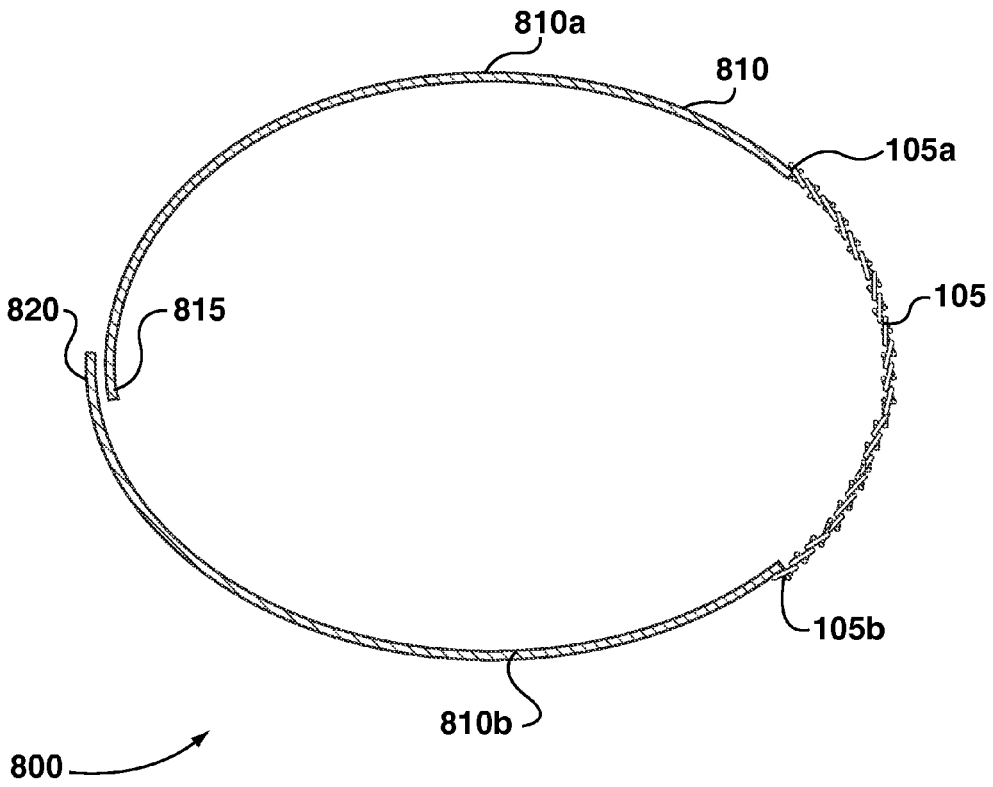
FIG. 8 depicts a cross-section of an embodiment of the protective shield, in which the support segment can comprise two portions.

FIG. 8 shows a cross-section of an embodiment of the protective shield 800 comprising a protective segment 105 secured to support segment 810. Protective segment 105 can have a first edge 105*a* and a second edge 105*b*. Support segment 810 can have two portions: a first potion 810*a* secured to first edge 105*a* and a second portion 810*b* secured to second edge 105*b*. First portion 810*a* can have an end 815 and second portion 810*b* can have an end 820. End 815 can be releasably securable to end 820 using any suitable means including but not limited to hook-and-loop fastener, zipper, buttons, and laces. One or both of portions 810*a* and 810*b* can be made of resilient materials. Portions 810*a* and 810*b* can be similar or different sizes.

Figure 9:
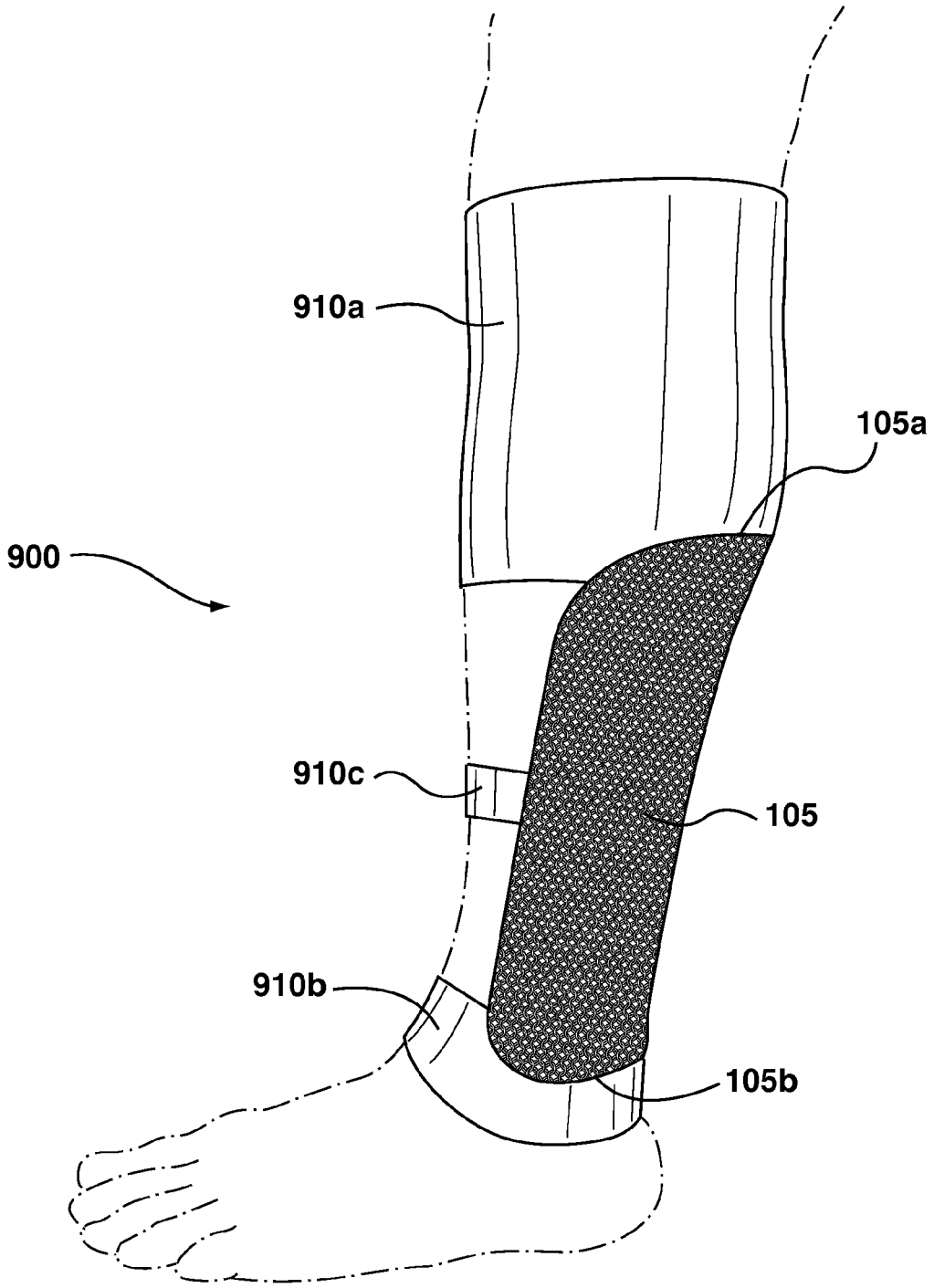
FIG. 9 depicts a side elevation view of another embodiment of the protective shield worn on the lower leg of a user, in which the support segment can comprise straps.

FIG. 9 shows an embodiment of the protective shield 900, worn on the lower leg of a user and viewed from the side. Protective shield 900 can comprise a protective segment 105 secured to a plurality of straps 910*a*, 910*b*, and 910*c* shaped and sized to wrap around the body part being protected, such as the lower leg as shown in FIG. 9. Straps 910*a*, 910*b*, and 910*c* can be made of a resilient material, can hold the protective shield in place around the lower leg during skating, and can tension the protective segment 105 against a body part of the user, including the rear portion of the lower leg as shown in FIG. 9. In some embodiments, there can be two straps: strap 910*a* secured to the first edge 105*a* of protective segment 105 and strap 910*b* secured to the second edge 105*b* of protective segment 105. In some embodiments there can be three or more straps.

Figure 10:
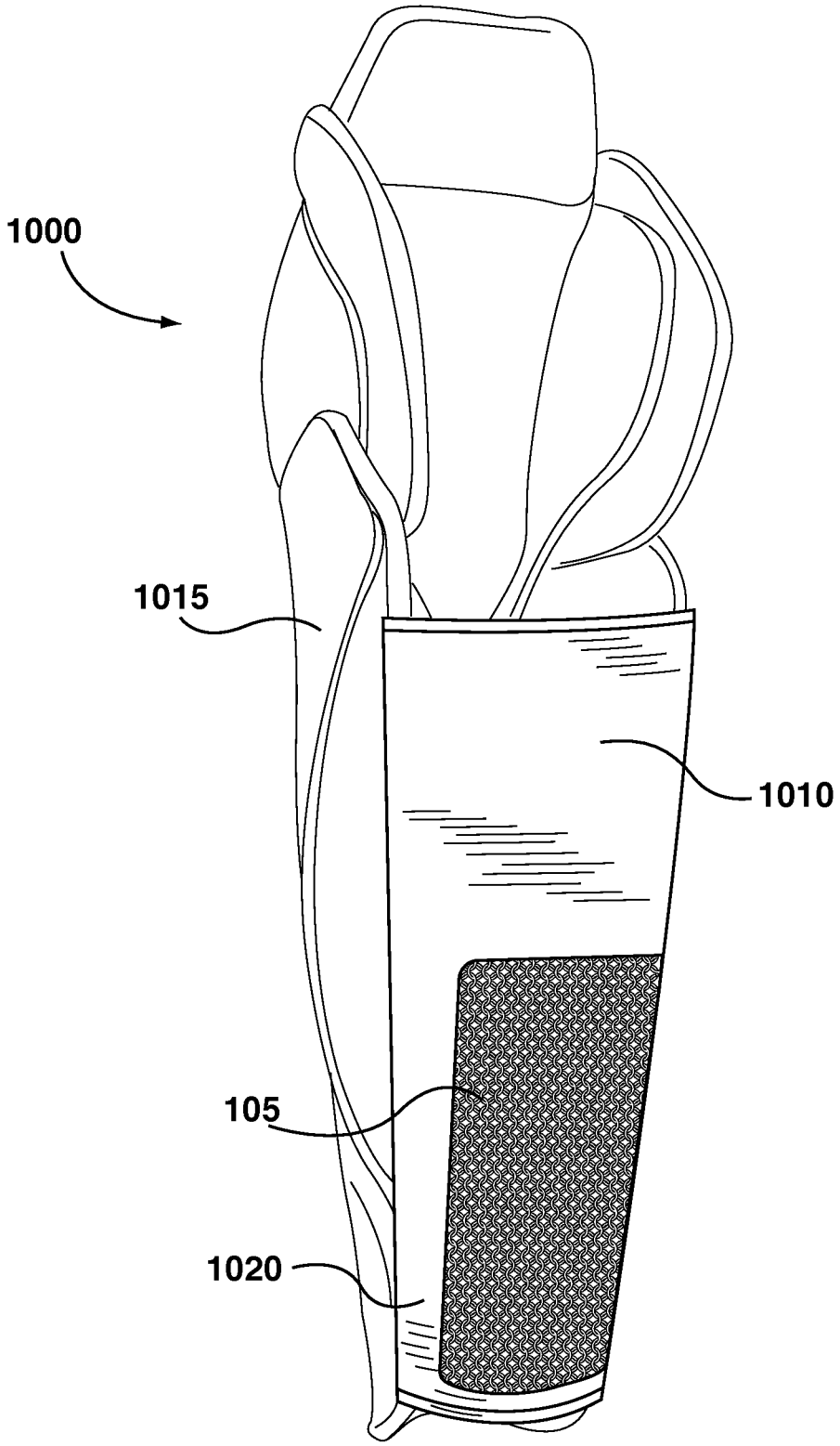
FIG. 10 depicts a perspective view of another embodiment of the protective shield.

FIG. 10 shows an embodiment of protective shield 1000, with a portion of the back and side of protective shield 1000 visible. Protective shield 1000 comprises a protective segment 105 secured to a support segment 1010. Protective segment 105 can comprise a web of interlocking loops, as discussed above. Protective segment 105 can be shaped and sized to fit over at least a rear portion of the lower leg of a user. Protective segment 105 can fit over a portion of an Achilles tendon and/or a portion of a calf of the user.

Protective segment 105 can be secured to support segment 1010 using a suitable means including but not limited to fusing, bonding, gluing, sewing, taping or any combination of such, as discussed above. Support segment 1010 can comprise a resilient portion 1020 and an impact absorbing section 1015. Support segment 1010 can be shaped and sized to fit round the lower leg of a user. Resilient portion 1020 can be resiliently stretched when protective shield 1000 is worn around the lower leg, and the resilient force of resilient portion 1020 can hold the protective shield 1000 in place around the lower leg during vigorous and/or athletic activity such as skating. The resilient force of resilient portion 1020 holding protective shield 1000 in place can allow protective shield 1000 to be designed without straps or other means of securing protective shield 1000 to the lower leg. This in turn can reduce the cost and complexity of manufacturing protective shield 1000. Resilient force of resilient portion 1020 can also tension protective segment 105 against the rear portion of the lower leg.

Impact absorbing section 1015 can comprise a padded section to absorb external impacts. The padding material compresses and/or deforms in response to the impact, and in so doing absorbs at least some of the impact energy, thereby protecting the leg from the full force of the impact. The padding can be made of a suitable material including, but not limited to, foams and elastomers. Alternatively and/or in addition, impact absorbing section 1015 can comprise a hard shield (not shown) to absorb an impact force and distribute it over a larger area of the leg, thereby reducing any localized damage caused by the impact force. In some embodiments, impact absorbing section 1015 can be secured to the inside and/or outside surface of support segment 1010. In other embodiments, impact absorbing section 1015 can be integrally formed with support segment 1010. In yet other embodiments support segment 1010 can comprise a plurality of layers, and impact absorbing section 1015 can be encased between layers of support segment 1010.

Impact absorbing section 1015 can be designed to cover one or multiple regions of the lower leg, including but not limited to, the shin, the knee cap, and the areas around the knee cap. As shown in FIG. 10, protective shield 1000 can be implemented as an ice hockey shin pad, with protective segment 105 covering the Achilles tendon and calf regions of the skater's leg.

Figure 11:
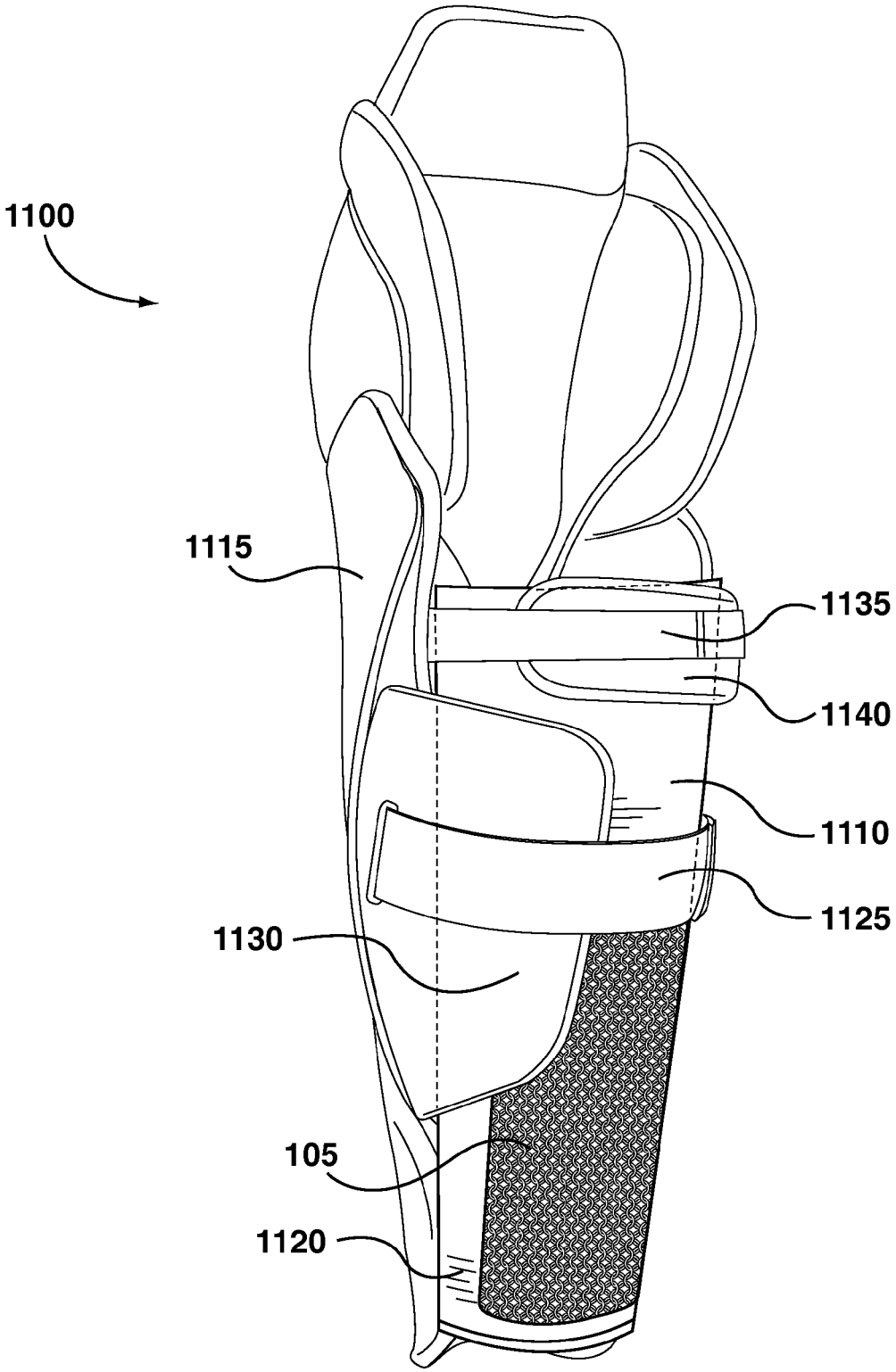
FIG. 11 depicts a perspective view of another embodiment of the protective shield.

FIG. 11 shows an embodiment of protective shield 1100, with a portion of the back and side of protective shield 1100 visible. Protective shield 1100 can comprise a protective segment 105 secured to a support segment 1110. Protective segment 105 can comprise a web of interlocking loops, as discussed above. Protective segment 105 can be secured to support segment 1110 in a manner similar to that discussed above in relation to the other example embodiments. As discussed in relation to protective shield 1000 above, support segment 1110 can comprise a resilient portion 1120 and at least one impact absorbing section 1115. As shown in FIG. 11, protective shield 1100 can also be implemented as an ice hockey shin pad, with protective segment 105 covering the Achilles tendon and calf regions of the skater's leg.

Protective shield 1100 can have straps 1125, 1135 extending across the calf of the skater to tighten and secure protective shield 1100 on the lower leg of the skater. Straps 1125, 1135 can be secured using a suitable means including, but not limited to, hook-and-loop fastener, buckles, laces, and clasps. In some embodiments, not shown, protective shield 1100 can have one strap or more than two straps. Straps 1125, 1135 can be placed in configurations different than that shown in FIG. 11: for example, straps 1125, 1135 can be higher or lower in relation to the skater's calf, or straps 1125, 1135 can crisscross each other.

As shown in FIG. 11, strap 1125 can have corresponding wing 1130 which is shaped and sized to extend partially around the rear portion of the lower leg. Wing 1130 can be impact absorbing to provide extra protection for the lower leg of the skater wearing protective shield 1100. Wing 1130 can be fully or partially padded. Strap 1135 can have a corresponding wing 1140, which can have a similar structure and function as wing 1130. In some embodiments, not shown, only some or none of the straps can have wings.

Figure 12:
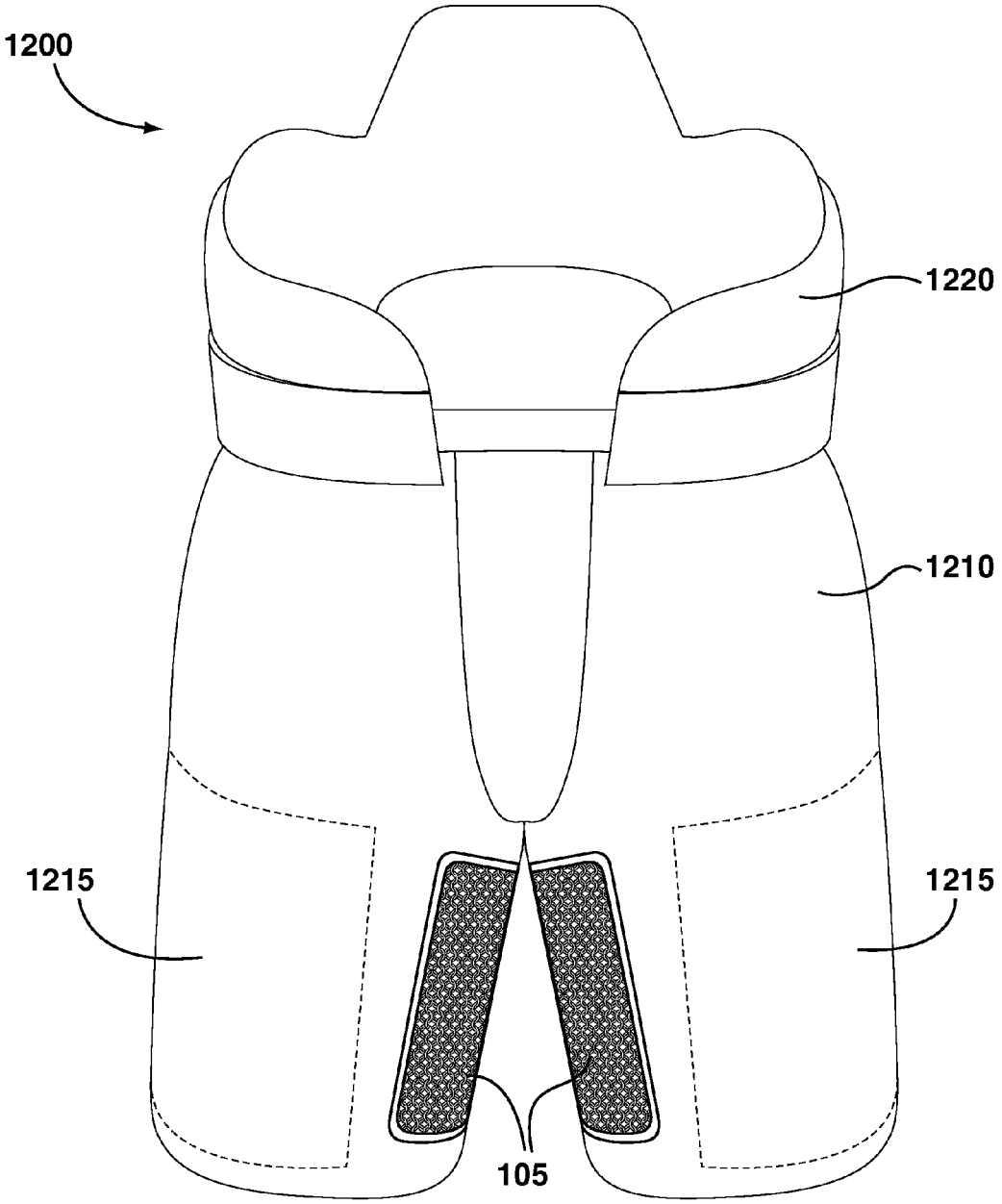
FIG. 12 depicts a perspective view of another embodiment of the protective shield.

FIG. 12 shows an embodiment of an athletic protective shield 1200. Protective shield 1200 can comprise protective segments 105 secured to a support segment 1210 using a suitable means including, but not limited to, fusing, bonding, gluing, sewing, taping or any combination of such. Protective segments 105 can comprise a web of interlocking loops, as discussed above. Protective segments 105 can be shaped and sized to fit over at least a portion of a body part of the user. As shown in FIG. 12, protective segments 105 can fit over and protect a portion of the inner thighs of the user.

Support segment 1210 can comprise one or more impact absorbing sections 1215, 1220. In other embodiments, not shown, one or more impact absorbing sections can be placed in other areas of support segment 1210 to protect different body parts of the user. In addition to and/or instead of pads, impact absorbing sections can comprise a hard material for absorbing the impact force and distributing it over a larger area to minimize the damage done by the force to the body of the user. Support segment 1210 can be shaped and sized to fit around the body part that the protective segment 105 is covering. Support segment 1210 can hold protective shield 1200 in place around the body part of the user during athletic movement and can tension protective segment 105 against the body part being covered by protective segment 105.

As shown in FIG. 12, support segment 1210 can be implemented as ice hockey pants, with impact absorbing sections 1215, 1220 representing thigh pads and kidney pads respectively. Hockey pants can be a protective garment covering the body from about the midriff to about the knees of a hockey player. In some cases hockey pants can extend below the knees. Hockey pants can be partially or fully padded or otherwise comprising impact absorbing sections. The padded and/or hard impact distributing sections can be placed in different parts of the hockey pants to protect different body parts of the user. Although the depicted embodiment shown in FIG. 12 has two symmetrical protective segments 105, in other embodiments, not shown, protective segments for each side of the body can be of different shape and/or size. In other embodiments, one, three, or any number of protective segments can be used to protect different body parts of the user. Different parts of hockey pants support segment 1210 can be resilient, or tightenable using laces, straps, or other suitable means, to keep the hockey pants in place during skating and to tension protective segments 105 against the inner thighs of the user.

The above-described embodiments of the invention are intended to be examples of the present invention and alterations and modifications may be effected thereto, by those of skill in the art, without departing from the scope of the invention which is defined solely by the claims appended hereto.

I claim:

1. A protective shield for a lower leg of an ice skater, the protective shield comprising:

a protective segment comprising a web of interlocking metal loops, each metal loop formed from an elongated member separate from other elongated members forming other metal loops, the protective segment having an outer perimeter comprising an outline of the protective segment when the web of interlocking metal loops is laid flat, the protective segment shaped and sized to fit over at least a rear portion of the lower leg including at least a portion of an Achilles tendon and at least a portion of a calf; and a support segment to which the protective segment is secured, the protective segment secured to an edge of the support segment along at least a portion of the outer perimeter, the support segment comprising a resilient fabric consisting of non-metallic fibers, the support segment being non-coextensive with the protective segment, the support segment shaped and sized to fit around the lower leg, the support segment being resilient to hold the protective shield in place around the lower leg during skating and to tension the protective segment against the rear portion of the lower leg.

2. The protective shield of claim 1, wherein the interlocking metal loops are made of steel.

3. The protective shield of claim 1, wherein the interlocking metal loops are made of titanium.

4. The protective shield of claim 1, wherein at least one of the interlocking metal loops is welded to form an unbroken loop.

5. The protective shield of claim 1, wherein the support segment comprises a fabric having elastane.

6. The protective shield of claim 1, wherein the protective segment and the support segment are permanently secured together to form a unitary piece.

7. The protective shield of claim 1, wherein the protective shield is shaped as a hockey sock.

8. The protective shield of claim 1, wherein the support segments defines an opening having an opening perimeter defining said edge and shaped to receive at least a received portion of the outer perimeter of the protective segment, the protective segment secured to the support segment by securing at least the received portion of the outer perimeter to a corresponding portion of the opening perimeter.

9. The protective shield of claim 1, wherein the support segment comprises one or more straps shaped and sized to wrap around the lower leg, the straps being resilient to hold the protective shield in place around the lower leg during skating and to tension the protective segment against the rear portion of the lower leg.

10. The protective shield of claim 1, wherein when the protective shield is worn by the ice skater, the interlocking loops being able to move relative to each other when the interlocking loops are struck by a skate blade of another ice skater.

11. The protective shield of claim 1, wherein when the protective shield is worn by the ice skater, the protective segment being able to move relative to the support segment when the protective segment is struck by a skate blade of another ice skater, and the protective shield being able to move relative to the ice skater when the protective shield is struck by the skate blade of the other ice skater.

12. An athletic protective shield, comprising:

a protective segment comprising a web of interlocking metal loops, each metal loop formed from an elongated member separate from other elongated members forming other metal loops, the protective segment having an outer perimeter comprising an outline of the protective segment when the web of interlocking metal loops is laid flat, the protective segment shaped and sized to fit over a body part of a user; and a support segment to which the protective segment is secured, the protective segment secured to an edge of the support segment along at least a portion of the outer perimeter, the support segment comprising a resilient fabric consisting of non-metallic fibers, the support segment being non-coextensive with the protective segment, the support segment shaped and sized to fit around the body part, the support segment being resilient to hold the athletic protective shield in place around the body part during athletic movement and to tension the protective segment against the body part;

wherein the body part comprises one of a lower leg, a fore-arm, and an upper-leg.

13. A protective shield for a lower leg of an ice skater, the protective shield comprising:

a protective segment comprising a web of interlocking metal loops, each metal loop formed from an elongated member separate from other elongated members forming other metal loops, the protective segment having an outer perimeter comprising an outline of the protective segment when the web of interlocking metal loops is laid flat, the protective segment shaped and sized to fit over at least a rear portion of the lower leg including at least a portion of an Achilles tendon and at least a portion of a calf; and a support segment to which the protective segment is secured, the protective segment secured to an edge of the support segment along at least a portion of the outer perimeter, the support segment comprising a resilient fabric consisting of non-metallic fibers, the support segment being non-coextensive with the protective segment, the support segment further comprising at least one impact absorbing section, the support segment shaped and sized to fit around the lower leg, at least a portion of the support segment being resilient to hold the protective shield in place around the lower leg during skating and to tension the protective segment against the rear portion of the lower leg.

14. The protective shield of claim 13, wherein the impact absorbing section comprises a padded section.

15. The protective shield of claim 13, wherein the support segment comprises an ice hockey shin pad.

16. The protective shield of claim 15, further comprising at least one strap for extending across the calf and securing the shin pad to the lower leg.

17. An athletic protective shield, comprising:

a protective segment comprising a web of interlocking metal loops, each metal loop formed from an elongated member separate from other elongated members forming other metal loops, the protective segment having an outer perimeter comprising an outline of the protective segment when the web of interlocking metal loops is laid flat, the protective segment shaped and sized to fit over at least a portion of a body part of a user; and a support segment to which the protective segment is secured, the protective segment secured to an edge of the support segment along at least a portion of the outer perimeter, the support segment comprising a resilient fabric consisting of non-metallic fibers, the support segment being non-coextensive with the protective segment, the support segment further comprising at least one impact absorbing section, the support segment shaped and sized to fit around the body part, the support segment configured to hold the athletic protective shield in place around the body part during athletic movement and to tension the protective segment against the body part, wherein the body part comprises one of a lower leg, and an upper-leg.

18. The athletic protective shield of claim 17, wherein the impact absorbing section is a padded section.

19. The athletic protective shield of claim 17, wherein the body part comprises an inner thigh of the user and the support segment comprises ice hockey pants.

20. An athletic protective shield, comprising:

a protective segment comprising a web of interlocking metal loops, each metal loop formed from an elongated member separate from other elongated members forming other metal loops, the protective segment having an outer perimeter comprising an outline of the protective segment when the web of interlocking metal loops is laid flat, the protective segment shaped and sized to fit over a body part of a user;

a support segment to which the protective segment is secured, the protective segment secured to an edge of the support segment along at least a portion of the outer perimeter, the support segment being non-coextensive with the protective segment, the support segment shaped and sized to fit around the body part, the support segment being resilient to hold the athletic protective shield in place around the body part during athletic movement and to tension the protective segment against the body part; and a fabric layer covering one side of the protective segment, the fabric layer secured to the support segment, the fabric layer configured to be disposed between the protective segment and the body part when the athletic protective shield is worn around the body part;

wherein the body part comprises one of a lower leg, a fore-arm, and an upper-leg.

* * * * *